10/8/85 OR 4,545,795

United States Patent [19]

Liu et al.

[11] Patent Number: 4,545,795

[45] Date of Patent: Oct. 8, 1985

[54] DUAL MIXED REFRIGERANT NATURAL GAS LIQUEFACTION

[75] Inventors: Yu-Nan Liu, Whitehall; James W. Pervier, West Chester, both of Pa.

[73] Assignee: Air Products and Chemicals, Inc., Allentown, Pa.

[21] Appl. No.: 545,409

[22] Filed: Oct. 25, 1983

[51] Int. Cl.[4] ..... F25J 1/02

[52] U.S. Cl. ..... 62/11; 62/40; 62/335

[58] Field of Search ..... 62/9, 11, 40, 335

[56] References Cited

U.S. PATENT DOCUMENTS

| | | | |
|---|---|---|---|
| 4,094,655 | 6/1978 | Krieger | 62/40 |
| 4,112,700 | 9/1978 | Forg | 62/28 |
| 4,274,849 | 6/1981 | Garier et al. | 62/9 |
| 4,339,253 | 7/1982 | Caetani et al. | 62/40 |

OTHER PUBLICATIONS

Paradowski, H. and Sguera, O., "La Liquefaction des Gas Associes", 7th International Conference on LNG, May 15-19, 1983, (Abstract in English).

*Primary Examiner*—Frank Sever

*Attorney, Agent, or Firm*—Geoffrey L. Chase; E. Eugene Innis; James C. Simmons

[57] ABSTRACT

A process and apparatus is described for liquefying natural gas using two closed cycle, multicomponent refrigerants wherein a low level refrigerant cools and liquefies the gas by indirect heat exchange and a high level refrigerant cools and partially liquefies the low level refrigerant by indirect multistage heat exchange. The high level refrigerant is phase separated in order to use lighter refrigerant components to perform the final lowest level of refrigeration while the liquid phase of the separation is split and then expanded for refrigeration duty in order to avoid multiple flash separations wherein heavier components are used to provide the lower levels of refrigeration.

13 Claims, 1 Drawing Figure

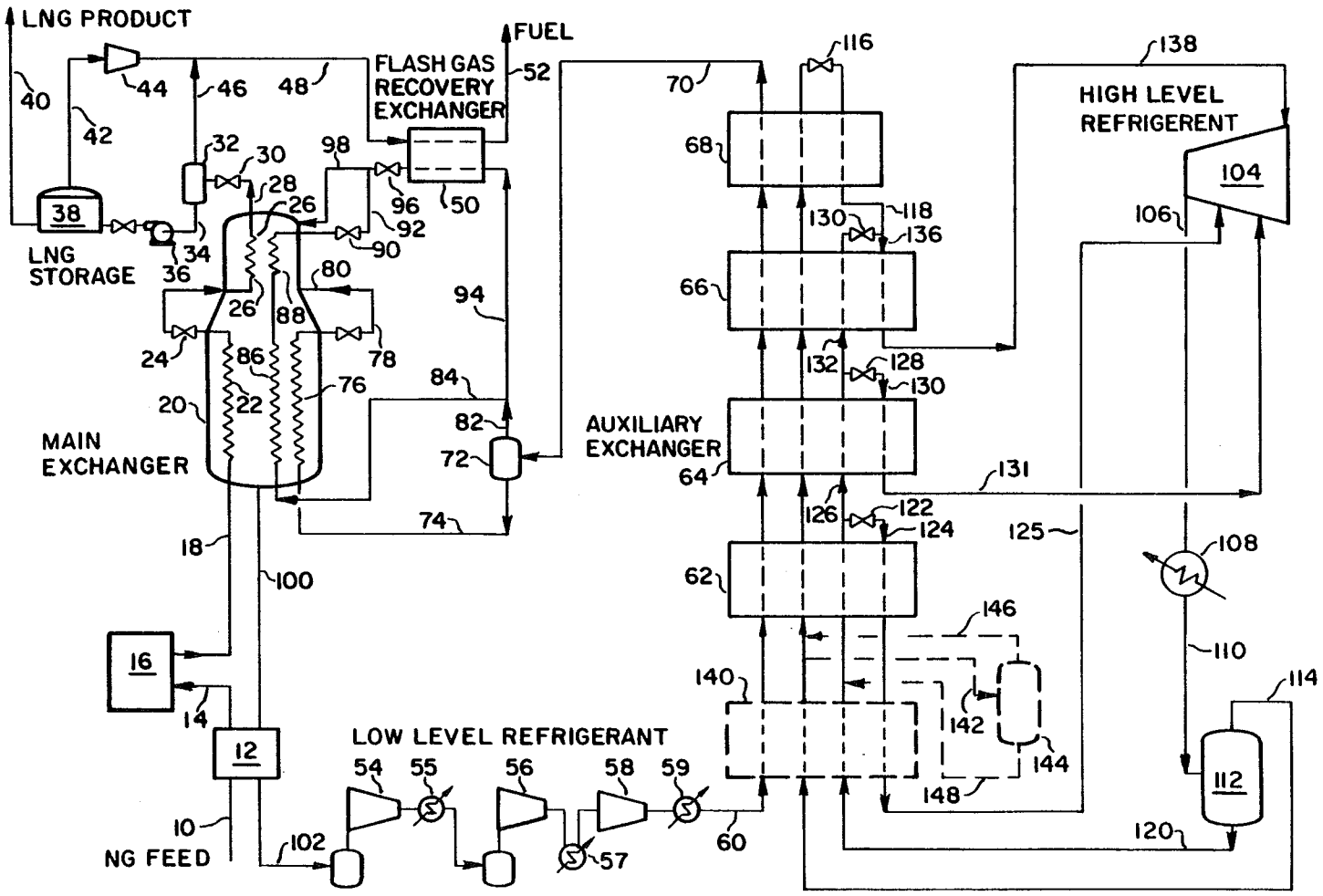
HIGH LEVEL REFRIGERENT
AUXILIARY EXCHANGER
FLASH GAS RECOVERY EXCHANGER
FUEL
LOW LEVEL REFRIGERANT
LNG PRODUCT
LNG STORAGE
MAIN EXCHANGER
NG FEED

DUAL MIXED REFRIGERANT NATURAL GAS LIQUEFACTION

TECHNICAL FIELD

The present invention is directed to a process for the liquefaction of natural gas and other methane-rich gas streams. The invention is more specifically directed to a dual mixed refrigerant liquefaction process utilizing a more efficient flowpath for the refrigerants utilized to liquefy natural gas or methane-rich gas streams.

BACKGROUND OF THE PRIOR ART

The recovery and utilization of natural gas and other methane-rich gas streams as an economic fuel source have required the liquefaction of the natural gas in order to provide economic transportation of the gas from the site of production to the site of use. Liquefaction of large volumes of natural gas is obviously energy intensive. In order for natural gas to be available at competitive prices, the liquefaction process must be as energy efficient as possible.

Additionally, in light of the increased costs of all forms of energy, a natural gas liquefaction process must be as efficient as practical in order to minimize the amount of fuel or energy required to perform the liquefaction.

Certain conditions, such as low cooling water temperature (below 65° F.) create reductions in liquefaction efficiency in single component cycles when the compression load on the refrigeration equipment used to perform the liquefaction is not balanced with regard to the drivers or machinery utilized to run the refrigeration equipment. Compression load is the major power consuming function of a liquefaction process. A liquefaction process must be readily adaptable to varying climactic conditions, wherein the liquefaction process must be efficient at operating ambient conditions in tropical environments, as well as temperate environments and cold environments, such as the subarctic regions of the world. Such climatic conditions effect a liquefaction process predominantly in the temperature of the cooling water utilized in the production of refrigeration used to liquefy the natural gas. Sizeable variations in the temperature of available cooling water due to changing seasons or different climatic zones can cause imbalances in the various refrigeration cycles of dual cycles.

Various attempts have been made to provide efficient liquefaction processes, which are readily adaptable to varying ambient conditions. In U.S. Pat. No. 4,112,700 a liquefaction scheme for processing natural gas is set forth wherein two closed cycle refrigerant streams are utilized to liquefy natural gas. A first high level precool refrigerant cycle is utilized in multiple stages to cool the natural gas. This first high level precool refrigerant is phase separated in multiple stages wherein the effect is to return the light portions of the refrigerant for recycle, while the heavy portions of the refrigerant are retained to perform the cooling at lower temperatures. The first high level precool refrigerant is also utilized to cool the second low level refrigerant. The second low level refrigerant performs the liquefaction of the natural gas in a single stage. The drawback in this process is that the high level precool refrigerant utilizes heavier and heavier components to do lower and lower temperature cooling duty. This is contrary to the desired manner of efficient cooling. Further, the second or low level refrigerant is used in a single stage to liquefy the natural gas, rather than performing such liquefaction in multiple stages.

U.S. Pat. No. 4,274,849 discloses a process for liquefying a gas rich in methane, wherein the process utilizes two separate refrigeration cycles. Each cycle utilizes a multicomponent refrigerant. The low level refrigerant cools and liquefies the natural gas in two stages by indirect heat exchange. The high level refrigerant does not heat exchange with the natural gas to be liquefied, but cools the low level refrigerant by indirect heat exchange in an auxiliary heat exchanger. This heat exchange is performed in a single stage.

U.S. Pat. No. 4,339,253 discloses a dual refrigerant liquefaction process for natural gas, wherein a low level refrigerant cools and liquefies natural gas in two stages. This low level refrigerant is in turn cooled by a high level refrigerant in a single stage. The high level refrigerant is used to initially cool the natural gas only to a temperature to remove moisture therefrom before feeding the dry natural gas to the main liquefaction area. The use of such individual stage heat exchange between the cycles of a dual cycle refrigerant liquefaction process precludes the opportunity to provide closely matched heat exchange between the cycles by the systematic variation of the refrigerant compositions when the refrigerants constitute mixed component refrigerants.

In the literature article Paradowski, H. and Squera, O. "Liquefaction of the Associated Gases", Seventh International Conference on LNG, May 15–19, 1983, a liquefaction scheme is shown in FIG. 3 wherein two closed refrigeration cycles are used to liquefy a gas. The high level cycle depicted at the right of the flowscheme is used to cool the low level cycle as well as cooling for moisture condensation in an initial gas stream. The high level refrigerant is recompressed in multiple stages and cools the low level refrigerant in three distinct temperature and pressure stages. Alteration of the high level refrigerant composition to match the various stages of refrigeration in the heat exchanger is not contemplated.

The present invention overcomes the drawbacks of the prior art by utilizing a unique flowscheme in a liquefaction process utilizing two mixed component refrigerants in closed cycles, wherein the refrigerants are indirectly heat exchanged one with another in multiple stages including varying the refrigerant composition wherein the lighter components are available to perform the lower level refrigeration duty.

BRIEF SUMMARY OF THE INVENTION

The present invention is a process for the liquefaction of natural gas using two closed cycle multicomponent refrigerants, wherein high level refrigerant cools the low level refrigerant and the low level refrigerant cools and liquefies the natural gas, comprising the steps of; cooling and liquefying a natural gas stream by heat exchange with a low level multicomponent refrigerant in a first closed refrigeration cycle which refrigerant is rewarmed during said heat exchange, compressing said rewarmed low level refrigerant to an elevated pressure and aftercooling it against an external cooling fluid, further cooling said low level refrigerant by multiple stage heat exchange against a high level multicomponent refrigerant in a second closed refrigeration cycle which high level refrigerant is rewarmed during said heat exchange, compressing said rewarmed high level refrigerant to an elevated pressure and aftercooling it against an external cooling fluid to partially liquefy said refrigerant, phase separating said high level refrigerant into a vapor phase refrigerant stream and a liquid phase refrigerant stream, subcooling and expanding portions of the liquid phase refrigerant stream to lower temperature and pressure in multiple stages to provide the cooling of the low level refrigerant and to cool and liquefy the vapor phase refrigerant stream, and expanding the liquefied vapor phase refrigerant stream to lower temperature and pressure to provide the lowest stage of cooling to the low level refrigerant. The rewarmed vapor phase refrigerant stream is combined with the lowest temperature level liquid phase refrigerant stream and the combined stream provides an intermediate level of cooling of the low level refrigerant. The rewarmed high level refrigerant streams are then recycled for compression at various pressure states.

The present invention also is an apparatus for the liquefaction of natural gas using two closed cycle, multicomponent refrigerants wherein the high level refrigerant cools the low level refrigerant and the low level refrigerant cools and liquefies the natural gas comprising; a heat exchanger for cooling and liquefying natural gas against a low level refrigerant, at least one compressor for compressing low level refrigerant to an elevated pressure, an auxiliary heat exchanger for cooling the low level refrigerant against high level refrigerant in multiple stages, a phase separator for separating the low level refrigerant into a vapor phase stream and a liquid phase stream, means for conveying the vapor phase stream and the liquid phase stream separately to said heat exchanger and recycling the same to said compressor, at least one additional compressor for compressing high level refrigerant to an elevated pressure, an aftercooling heat exchanger for cooling a compressed high level refrigerant against an external cooling fluid, a phase separator for separating the high level refrigerant into a vapor phase stream and a liquid phase stream, means for conveying said high level vapor phase stream through said auxiliary heat exchanger and expanding said stream in order to cool the low level stream, means for conveying said high level liquid phase stream through said auxiliary heat exchanger including means for separating portions of said stream therefrom and then individually expanding them to a lower temperature and pressure to cool said low level refrigerant, and means for recycling the high level refrigerant for recompression.

Preferably, the vapor phase stream of the high level refrigerant may be initially cooled against the liquid phase stream and then phase separated into a light vapor phase stream which is further cooled and expanded to provide refrigeration at the lowest level for the cooling of the low level refrigerant and a light liquid phase stream which is combined with the liquid phase stream from the first phase separator in the high level refrigerant cycle.

Alternately, the further phase separation of the vapor phase stream after partial liquefaction against liquid phase refrigerant is performed after a plurality of the multiple stages of heat exchange between the liquid phase stream of the high level refrigerant and the vapor phase stream of the high level refrigerant.

BRIEF DESCRIPTION OF THE DRAWING

The FIGURE is a schematic flowscheme of a preferred mode of operation of the present invention.

DETAILED DESCRIPTION OF THE INVENTION

The present invention will be described in greater detail with reference to the accompanying drawing wherein a preferred embodiment of the present invention is set forth. A natural gas feed stream is introduced into the process of the present invention in line 10. The natural gas would typically have a composition as follows:

$C_1$—91.69%
$C_2$—4.56%
$C_3$—2.05%
$C_4$—0.98%
$C_{5+}$—0.41%
$N_2$—0.31%

This feed is introduced at approximately 93° F. and over 655 PSIA. Prior to liquefaction, a significant portion of the hydrocarbons heavier than methane must be removed from the feed stream. In addition, any residual content of moisture must also be removed from the feed stream. These preliminary treatment steps do not form a portion of the present invention and are deemed to be standard pretreatment processes, which are well known in the prior art. Therefore, they will not be dealt with in the present description. Suffice it to say that the feed stream in line 10 is subjected to initial cooling by heat exchange in heat exchanger 12 against a low level (low temperature) refrigerant in line 100. The precooled natural gas now in line 14 is circuited through drying and distillation apparatus to remove moisture and higher hydrocarbons. This standard clean up step is not shown in the drawing other than to indicate that it is generally done prior to liquefaction at station 16.

The natural gas, now free of moisture and significantly reduced in higher hydrocarbons, is fed in line 18 to the main heat exchanger 20, which preferably consists of a two stage coil wound heat exchanger. The natural gas is cooled and totally condensed in the conduits 22 of the first bundle or stage of the main heat exchanger 20. The gas in liquefied form leaves the first stage of the main heat exchanger 20 at approximately −208° F. The liquefied natural gas is reduced in pressure through valve 24 and is then subcooled in conduit 26 of the second bundle or stage of the main heat exchanger 20 and leaves the exchanger at approximately −245° F. in line 28. The liquefied natural gas is reduced in pressure through valve 30 and is flashed in phase separator 32. The liquid phase of the natural gas is removed as a bottom stream in line 34 and is pumped to liquefied natural gas (LNG) storage by means of pump 36. LNG product can be removed from storage vessel 38 in line 40. Vapor from the LNG storage vessel 38 is removed in line 42 and recompressed in compressor 44. It is combined with vapor phase natural gas from phase separator 32 which is removed in line 46. The combined stream in line 48 is rewarmed in flash gas recovery heat exchanger 50 and exits in line 52 for use as fuel gas, preferably for operation of the equipment of the liquefaction plant.

The low level multicomponent refrigerant, which actually performs the cooling, liquefaction and subcooling of the natural gas, is typically comprised of nitrogen, methane, ethane, propane and butane. Alternatively, ethylene and propylene could be included in the refrigerant. The exact concentration of these various components in the low level refrigerant is dependent upon the ambient conditions, the composition of the feed natural gas, and particularly the temperature of external cooling fluids, which are used in the liquefaction plant. The exact composition and concentration range of the components of the low level refrigerant is also dependent upon the exact power shift or balance desired between the low level refrigerant cycle and the high level refrigerant cycle.

The low level refrigerant is compressed in multiple stages through compressor 54, 56 and 58. The heat of compression is also removed by passing the refrigerant from the various stages of compression through heat exchangers 55, 57 and 59 which are cooled by an external cooling fluid. Preferably, the external cooling fluid would be water at ambient conditions. Typically, for an LNG plant near a harbor location where liquefaction is most desirous, the cooling water would be ambient sea water.

The low level refrigerant at approximately 100° F. and above 500 psia and containing predominantly methane and ethane with lesser amounts of propane and nitrogen is introduced into the first stage of a four stage auxiliary heat exchanger. The heat exchanger provides the means for heat exchanging the low level refrigerant against the high level refrigerant. The high level indicates that the refrigerant is relatively warmer during its cooling duty than the low level refrigerant. The low level refrigerant in line 60 passes through the first stage heat exchanger 62 and is reduced in temperature, but is still above the point of liquefaction. The stream continues through the auxiliary heat exchanger in stage 64 and is partially liquefied. The low level refrigerant is further reduced in temperature through heat exchanger stages 66 and 68, but is not fully liquefied. Each stage of the auxiliary heat exchanger provides a lower level of cooling, such that heat exchanger 62 is relatively warmer than heat exchanger 68, which is the coldest point in the auxiliary heat exchanger. The two phase low level refrigerant in line 70 is then introduced into a phase separator 72. The liquid phase of the low level refrigerant is removed as a bottom stream in line 74. This stream is introduced into the main heat exchanger 20 in tube conduit 76 of the first bundle. The liquid phase low level refrigerant is subcooled and is removed from a reduction in pressure and temperature through valve 78. The refrigerant is then introduced into the shell side of the coil wound main heat exchanger through line 80 as a spray of descending refrigerant, which cools the various streams in the first stage or bundle of the main heat exchanger by indirect heat exchange.

The vapor phase from separator vessel 72 is removed as an overhead stream in line 82. The bulk of the vapor phase low level refrigerant is directed though line 84 for liquefaction in conduit 86 of the first bundle or stage of the main heat exchanger 20. The refrigerant in conduit 86 is subcooled in conduit 88 of the second bundle or stage of the main heat exchanger 20. The subcooled liquid refrigerant is reduced in temperature and pressure through valve 90. A slip stream of the vapor phase refrigerant from the phase separator 72 is removed in line 94 for recovery of refrigeration value from a flash gas from LNG storage in heat exchanger 50. This slip stream is reduced in temperature and pressure in valve 96 and is combined with the other portion of the initially vapor phase refrigerant now in line 92. The combined streams in line 98 are introduced into the head of the main heat exchanger 20 and the refrigerant is sprayed over the second bundle containing conduits 26 and 88 and subsequently the first bundle containing conduits 22, 86 and 76. The second bundle constitutes the lower level of refrigeration provided by the heat exchanger 20. The low pressure and rewarmed low level refrigerant, after heat exchange duty in the main heat exchanger 20, is removed from the base of said heat exchanger in line 100. The low level refrigerant provides initial cooling of the natural gas feed in heat exchanger 12 before being recycled for recompression in line 102.

A high level refrigerant, which is utilized at a refrigeration duty temperature significantly above the low level refrigerant, constitutes the second of the two closed cycle refrigerant systems of the present invention. The high level refrigerant is utilized preferbly only to cool the low level refrigerant in indirect heat exchange. The high level refrigerant can alternately perform a cooling function in the natural gas which is being liquefied such as in exchanger 12 wherein it would close up the cooling curves of the various streams. The high level refrigerant can typically contain:

$C_2$—28.79%*
$C_3$—67.35%*
$C_4$—3.86%

*Alternately, ethylene and propylene may be used in the refrigerant.

This high level refrigerant is introduced at various pressure levels into a multistage compressor 104. After optional interstage cooling, the high level refrigerant in the vapor phase is removed in line 106 at a temperature of 170° F. and a pressure of approximately 350 psia. The refrigerant is aftercooled in heat exchanger 108 against an external cooling fluid, such as ambient temperature water. The high level refrigerant is partially condensed by the external cooling fluid and exits the heat exchanger in line 110 in a vapor and liquid phase mixture. The vapor and liquid phases of the high level refrigerant are separated in phase separator 112. The vapor phase is removed from the top of the phase separator 112 in line 114.

The vapor phase stream of the high level refrigerant is then passed through the auxiliary heat exchanger and particularly stages 62, 64, 66 and 68 in order to cool and liquefy the vapor phase stream. The liquefied vapor phase stream is then expanded to a reduced temperature and pressure through valve 116. The now two phase refrigerant at approximately −55° F. is countercurrently passed back through the final cold or low level stage 68 of the auxiliary heat exchanger to provide the lowest level of cooling for the low level refrigerant in line 70, as well as the vapor phase stream in line 114. This two phase refrigerant exits the final stage 68 of the auxiliary heat exchanger in line 118 as a two phase stream at approximately −30° F.

The liquid phase of the high level refrigerant is removed from the phase separator 112 as a bottom stream in line 120. This liquid phase stream is passed through the first stage 62 of the auxiliary heat exchanger and subcooled before a sidestream of the liquid phase refrigerant stream is removed and expanded to a reduced temperature and pressure in valve 122. This liquid phase sidestream in line 124, now a two phase stream, is introduced countercurrently back through the first stage 62 of the auxiliary heat exchanger in order to provide the cooling effect in that stage of the heat exchanger. The rewarmed refrigerant now in line 125 is recycled for recompression at an intermediate level of the compressor 104.

The remaining stream of the initially subcooled liquid phase refrigerant stream in line 126 is further subcooled in the second stage 64 of the auxiliary heat exchanger and a second sidestream is removed and expanded to a reduced temperature and pressure through valve 128. The now two phase refrigerant in line 130 is introduced countercurrently back through the second stage 64 of the auxiliary heat exchanger in order to provide cooling duty for that stage of the exchanger. The rewarmed refrigerant now in line 131 is recycled to the compressor 104 at an intermediate stage for recompression, which stage is lower pressurewise from the previous recycle stream 125. The second remaining stream of the liquid phase refrigerant in line 132 is further subcooled through the fluid stage 66 of the auxiliary heat exchanger before the entire stream is expanded through valve 130 to a reduced temperature and pressure and combined with the vapor phase stream in line 118. The combined stream in line 136 is passed countercurrently back through the third stage 66 of the auxiliary heat exchanger in order to provide the cooling or refrigeration duty for that stage of the heat exchanger. This refrigerant in line 138 is at the lowest pressure of all of the recycled streams and is reintroduced for recompression into compressor 104 at the lowest stage.

The flow scheme of the high level refrigerant allows for increased efficiencies in the cooling of the low level refrigerant against the high level refrigerant. Prior art cascade systems generally return light refrigerant components for recompression early in the heat exchange cycle and continued to isolate heavy components for refrigeration duty in the cold level heat exchange of a multistage heat exchange between fluids. The present invention performs an initial phase separation in separator 112 and then directs the light components of the high level refrigerant through the warm and intermediate level heat exchange stages before expanding the light component to a lower temperature and pressure for use at the cold stage of the auxiliary heat exchanger. The light components, being the lowest boiling, provide a better refrigerant for low level or cold refrigeration duty in the heat exchanger stage 68.

In addition, the liquid phase stream of the high level refrigerant emanating from the phase separation in separator 112 is split into various substreams not by phase separation as in the prior art, but by mere one phase separation of a portion of the overall liquid stream. Such non-phase separation prevents the accumulation of heavy components of the refrigerant for duty in the colder stages of the overall heat exchange. The present invention expands the separated refrigerant from the liquid phase refrigerant stream after the individual sidestream separation so that expansion provides a cooling effect and does not segregate light refrigerant components from heavy refrigerant components. By performing the refrigeration flow in this manner, a better refrigerant component fit is achieved for the various stages of the auxiliary heat exchanger wherein warm stage 62, intermediate stage 64 and colder stage 66 are fed with similar refrigerant streams, rather than refrigerant streams having heavier components as the refrigeration duty of the respective heat exchanger is lowered in temperature as in the prior art.

Further, in the colder intermediate stage 66 of the auxiliary heat exchanger the vapor phase refrigerant in line 118 is combined with the liquid stream in line 132 to provide refrigerant with a more desirable mix and higher concentration of light refrigerant components. This overall refrigerant flowscheme achieves improved efficiencies and results in a better thermodynamic fit between the refrigeration duty of the high level refrigerant and that of the low level refrigerant.

Preferably additional stages such as 140 of the auxiliary heat exchanger may be utilized wherein the vapor phase stream 114 is initially cooled in stage 140 and is then phase separated in separator vessel 144 with the result that even a lighter mix of refrigerant component is removed as an overhead in line 146 and sent for ultimate refrigeration duty in the coldest level of the auxiliary heat exchanger in stage 68. The liquid phase stream resulting from phase separation in 144 is removed in line 148 and is reintroduced into liquid phase refrigerant stream 120. This effects the transfer of additional heavy components from the vapor phase stream to the liquid phase stream to provide additional thermodynamic fit for the various levels of refrigeration duty. Alternately, stream 148 may be passed through stages 62, 64 and 66 and individually combined with stream 118 so as to further isolate light components for the cold end duty.

Alternately, such a cooling to partial condensation of the vapor phase stream with phase separation and isolation of light refrigerant components for lower temperature refrigeration duty can be repeated after each stage 62, 64 and 66 of the auxiliary heat exchanger.

The use of dual mixed refrigerant cycles in a liquefaction plant allows for a significant degree of freedom in the variation of the composition of each refrigerant cycle so as to shift the compression power load for the refrigerant from either the high level or low level refrigerant as the case may require dependent upon the availability of refrigeration duty from the ambient cooling fluid needed to aftercool both the high level and low level refrigerants subsequent to recompression. This benefit of dual mixed component refrigerant liquefaction is achieved with unique efficiency in the present invention.

Although the auxiliary exchanger is shown configured with the coldest stage at the highest position, it is contemplated that the auxiliary exchanger could be configured in the opposite order with the cold end at the lowest point and stream flows in a corresponding manner through the various stages.

It is also contemplated that refrigeration duty on the natural gas stream in exchanger 12, although shown to be supplied only by low level refrigerant, could be assisted by a slipstream of high level refrigerant. Conversely, a slipstream of natural gas could be removed from feed 10, cooled against high level refrigerant and then returned to exchanger 12. These embodiments are not illustrated.

The present invention has been described with respect to a preferred embodiment, but variations from this embodiment can be contemplated by those skilled in the art which variations are deemed to be within the scope of the patent. Therefore the scope of the patent should be ascertained by the claims which follow.

We claim:

1. A process for the liquefaction of natural gas using two closed cycle, multicomponent refrigerants wherein high level refrigerant cools a low level refrigerant and the low level refrigerant cools and liquefies the natural gas, comprising the steps of:

a. cooling and liquefying a natural gas stream by heat exchange with a low level multicomponent refrigerant in a first closed refrigeration cycle, which refrigerant is rewarmed during said heat exchange, b. compressing said rewarmed low level refrigerant to an elevated pressure and aftercooling it against an external cooling fluid, c. further cooling said low level refrigerant by indirect multiple stage heat exchange against a high level multicomponent refrigerant in a second closed refrigeration cycle, which high level refrigerant is rewarmed during said heat exchange, d. compressing said rewarmed high level refrigerant to an elevated pressure and aftercooling it against an external cooling fluid to partially liquefy said refrigerant, e. phase separating said high level refrigerant into a vapor phase refrigerant stream and a liquid phase refrigerant stream such that lighter refrigerant components are available for lower level refrigeration duty in the cooling step of clause c, f. subcooling and expanding portions of the liquid phase refrigerant stream to lower temperature and pressure in multiple stages to provide the cooling of the low level refrigerant of step (c) and to cool and liquefy the vapor phase refrigerant stream of step (e), g. cooling and then expanding the liquefied vapor phase refrigerant stream to lower temperature and pressure to provide the lowest stage of cooling to the low level refrigerant.

2. The process of claim 1 wherein the vapor phase high level refrigerant stream is initially cooled against the liquid phase high level refrigerant stream and then is phase separated into a light vapor phase stream, which is further cooled and expanded to provide the lowest stage of cooling to the low level refrigerant, and into a light liquid phase stream which is combined with the liquid phase refrigerant stream.

3. The process of claim 2 wherein the vapor phase high level refrigerant stream is cooled, phase separated, and further cooled in a plurality of stages.

4. The process of claim 1 wherein the low level refrigerant is phase separated and the liquid phase provides the initial cooling of the natural gas, while the vapor phase is split into a first stream which is cooled against the liquid phase and a second stream which is cooled against flash gas from the product liquefied natural gas before said first and second streams are combined to provide the final cooling and liquefaction of the natural gas.

5. The process of claim 1 wherein the compression of the low level refrigerant is conducted in multiple stages.

6. The process of claim 1 wherein the compression of the high level refrigerant is conducted in multiple stages.

7. The process of claim 1 wherein the external cooling fluid is water at ambient conditions.

8. The process of claim 7 wherein the water is below 65° F.

9. The process of claim 1 wherein the multicomponent refrigerants comprise two or more components selected from the following group: methane, ethane, ethylene, propane, propylene, butane, pentane and nitrogen.

10. An installation for the liquefaction of natural gas using two closed cycle, multicomponent refrigerants wherein high level refrigerant cools a low level refrigerant and the low level refrigerant cools and liquefies the natural gas, comprising:

a. a heat exchanger for cooling and liquefying natural gas against a low level refrigerant;

b. at least one compressor for compressing the low level refrigerant to an elevated pressure;

c. an auxiliary heat exchanger for indirectly cooling the low level refrigerant against high level refrigerant in multiple stages;

d. a phase separator for separating the low level refrigerant into a vapor phase stream and a liquid phase stream;

e. means for conveying the vapor phase stream and the liquid phase stream separately to said heat exchanger of paragraph (a) and recycling same to said compressor of paragraph (b);

f. at least one compressor for compressing high level refrigerant to an elevated pressure;

g. an aftercooling heat exchanger for cooling the compressed high level refrigerant against an external cooling fluid;

h. a phase separator for separating the high level refrigerant into a vapor phase stream and a liquid phase stream such that lighter refrigerant components are available for lower level refrigeration duty in the auxiliary heat exchanger of clause c;

i. means for conveying said high level vapor phase stream through said auxiliary heat exchanger and expanding said stream in order to provide the lowest stage of cooling to the low level refrigerant stream;

j. means for conveying said high level liquid phase stream through said auxiliary heat exchanger including means for separating portions of said stream therefrom and then individually expanding them to a lower temperature and pressure to cool said low level refrigerant;

k. means for recycling the high level refrigerant for recompression.

11. The apparatus of claim 10 including a phase separator for separating the high level vapor phase stream of paragraph (h) into a light vapor phase stream and a light liquid phase stream.

12. The apparatus of claim 11 including a plurality of phase separators for separating high level vapor phase refrigerant into light vapor phase streams and light liquid phase streams.

13. The apparatus of claim 10 wherein the compressors have multiple stages.

* * * * *